US005410833A

United States Patent [19]

Paterson

[11] Patent Number: 5,410,833

[45] Date of Patent: May 2, 1995

[54] RECOIL ABSORBING FIREARM STOCK

[76] Inventor: Douglas F. Paterson, 1002 Sun Dr., Colorado Springs, Colo. 80906

[21] Appl. No.: 92,699

[22] Filed: Jul. 16, 1993

[51] Int. Cl.[6] ..... F41C 23/06; F41C 23/14

[52] U.S. Cl. ..... 42/73; 42/74

[58] Field of Search ..... 42/1.06, 71.01, 73, 42/74; 89/1.42, 37.15

[56] References Cited

FOREIGN PATENT DOCUMENTS

| | | | |
|---|---|---|---|
| 470223 | 8/1914 | France | 42/74 |
| 8519 | 2/1879 | Germany | 42/74 |
| 300129 | 8/1932 | Italy | 42/74 |
| 160650 | 9/1957 | Sweden | 42/74 |
| 8892 | 5/1894 | United Kingdom | 42/74 |
| 964433 | 10/1982 | U.S.S.R. | 42/74 |

*Primary Examiner*—Stephen C. Bentley

*Attorney, Agent, or Firm*—Richard W. Hanes

[57] ABSTRACT

A gun stock adapted for absorbing recoil energy in a shoulder firearm which includes a stock butt portion and a stock grip portion interconnected by at least one compressible strut having an adjustable length cylinder where one end thereof is secured to the stock butt portion. A tubular shaft is telescopically disposed within the cylinder with its free end attached to the stock grip. A plug is disposed within the cylinder carrying a rod coaxial with the cylinder whose free end is disposed within the tubular shaft. A stack of disc shaped springs are coaxially positioned within the tubular shaft and are circumscribed around the rod, the stack being between the stock grip and the plug and adapted to be compressed upon movement of the shaft into the cylinder upon the firing of the gun.

8 Claims, 6 Drawing Sheets

Prior Art

Prior Art

RECOIL ABSORBING FIREARM STOCK

BACKGROUND OF THE INVENTION

Various different arrangements of springs, padding and energy absorbing devices have been utilized in an attempt to decrease the recoil energy felt from the impact of the butt end of a firearm stock on the shoulder of a shooter.

Although not related to recoil apparatus for shoulder fired guns, the most relevant prior art is that found in the U.S. Pat. No. to Balleisen, et al., U.S. Pat. No. 2,701,963. An experimental machine gun mount is disclosed in which the vibration frequency and amplitude can be varied to obtain the highest rate of fire from the gun. Part of the mounting apparatus includes a plurality of calibrated Belleville springs stacked on a pair of parallel rods. By variously arranging the springs in series, parallel or parallel-series, more or less resistance may be provided to oppose recoil of the gun and various conditions due to the gun fire may be determined by the number and arrangement of the springs employed. While this patent discloses the use of Belleville springs to absorb the energy of a firing gun, it does not teach or suggest the advantages and construction related to using the springs inside the stock of a shoulder fired rifle, nor the other necessary mechanical elements which are necessary to absorb the energy of a shoulder firearm and, at the same time, provide for stock length adjustment, as in the present invention.

In U.S. Pat. No. 4,164,825, Hutchison discloses a recoil reducing device comprising a piston suspended in a closed chamber filled with a viscous liquid. The piston includes outwardly or radially extending means which resist rapid movement of the piston in the liquid, thereby achieving some reduction in gun recoil speed which has a damping effect for recoil reduction. The structure of the Hutchison device is unlike that the of present invention and relies on entirely different principles of operation and does not teach stock length adjustment.

U.S. Pat. No. 3,754,344 discloses a gun stock having a separate movable member which moves against the compression of a pair of helical springs enclosed within the main portion of the gun stock. The basic theory of this patent in providing a compressible gun stock is similar to that of the present invention, however the spring arrangements disclosed in the '344 patent are very limited in the amount of shock which can be absorbed and in the adjustments which can be made in the device, all of which disadvantages are overcome by the present invention.

A simple form of recoil pad for attachment to the butt end of a firearm's stock is shown in U.S. Pat. No. 4,922,641. This device utilizes a series of helical springs, a cushion of interior air and a compressible foam member to aid in overall compressibility. While the intent is the same as that of the present invention, the structure and operation of the device is entirely distinct from that of the present invention.

With the disadvantages and limitations of the prior art in mind, it is the primary object of the invention to provide a recoil absorbing stock for rifles, shotguns and automatic rifles which is adjustable and is more effective for its purpose than any of the devices of the prior art.

A second object of the invention is to provide an adjustable length firearm stock together with a complimentary recoil reduction mechanism.

Another objective of the invention is to provide a firearm stock having separate and independent adjustments for stock length and recoil absorption characteristics where one does not affect the other.

A still further object of the invention is to double the utility of a recoil reduction mechanism by having it also serve as the stock of the firearm, capable of conveniently mounting a shooter's cheek piece.

Yet another object of the invention is to provide a recoil absorbing device utilizing disc springs in a novel manner in order to achieve maximum energy absorption with minimum of weight and space considerations.

Other and still further objects, features and advantages of the invention will be apparent upon a reading the description of the preferred form the of the invention, taken in conjunction with the accompanying drawings in which.

Figure 4A:
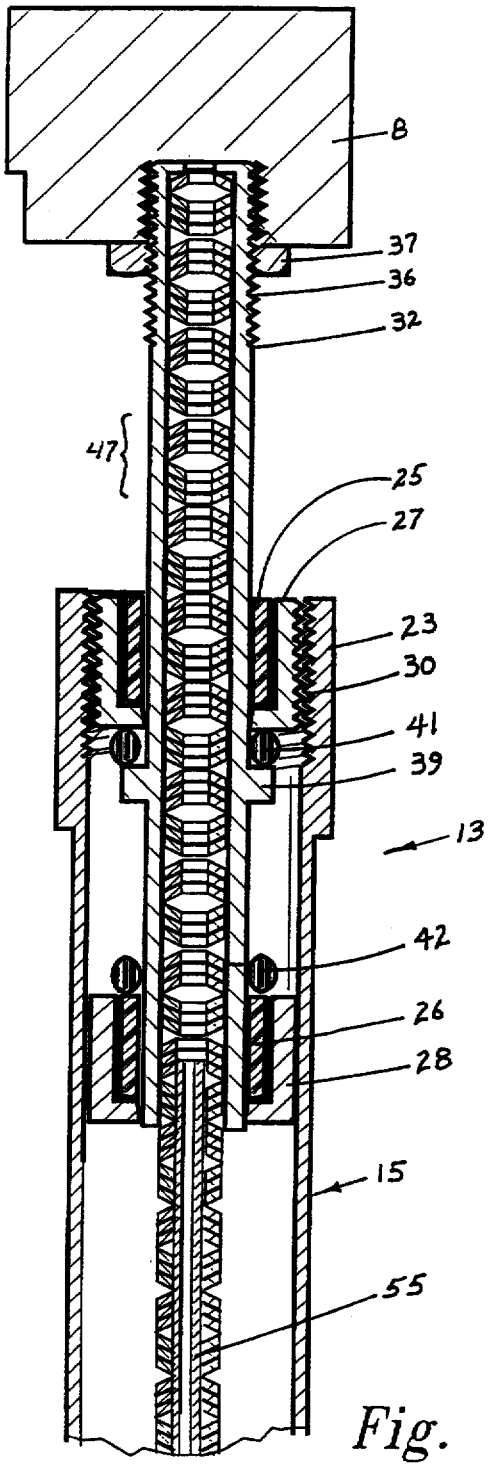

FIG. 4*a* is an enlarged fragmentary longitudinal cross section view of the absorber strut in the normal position.

Figure 4B:
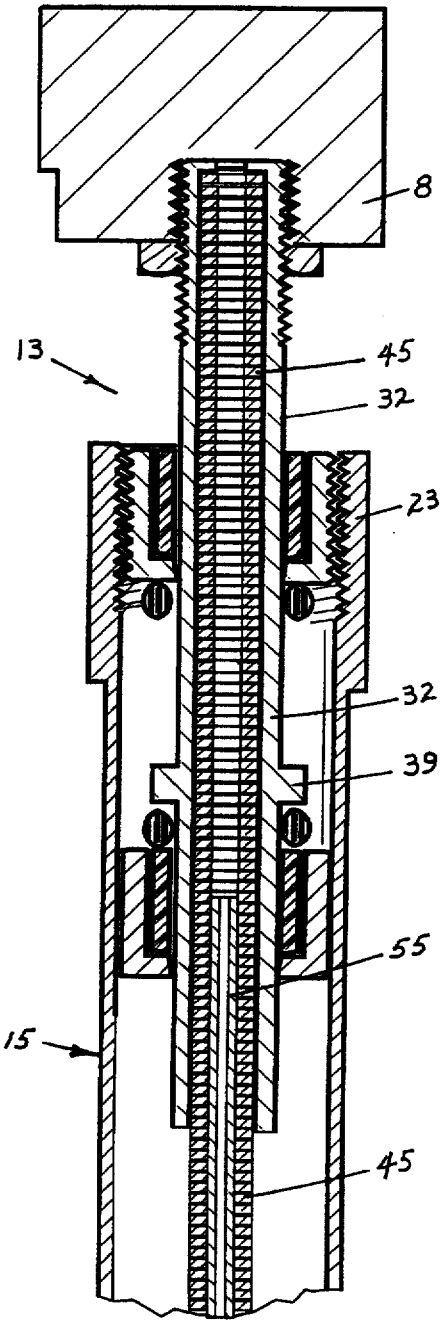

FIG. 4*b* is an enlarged fragmentary longitudinal cross section view of the absorber strut in the compressed firing mode where the springs are compressed as a result of the firing energy of the firearm.

Figure 3:
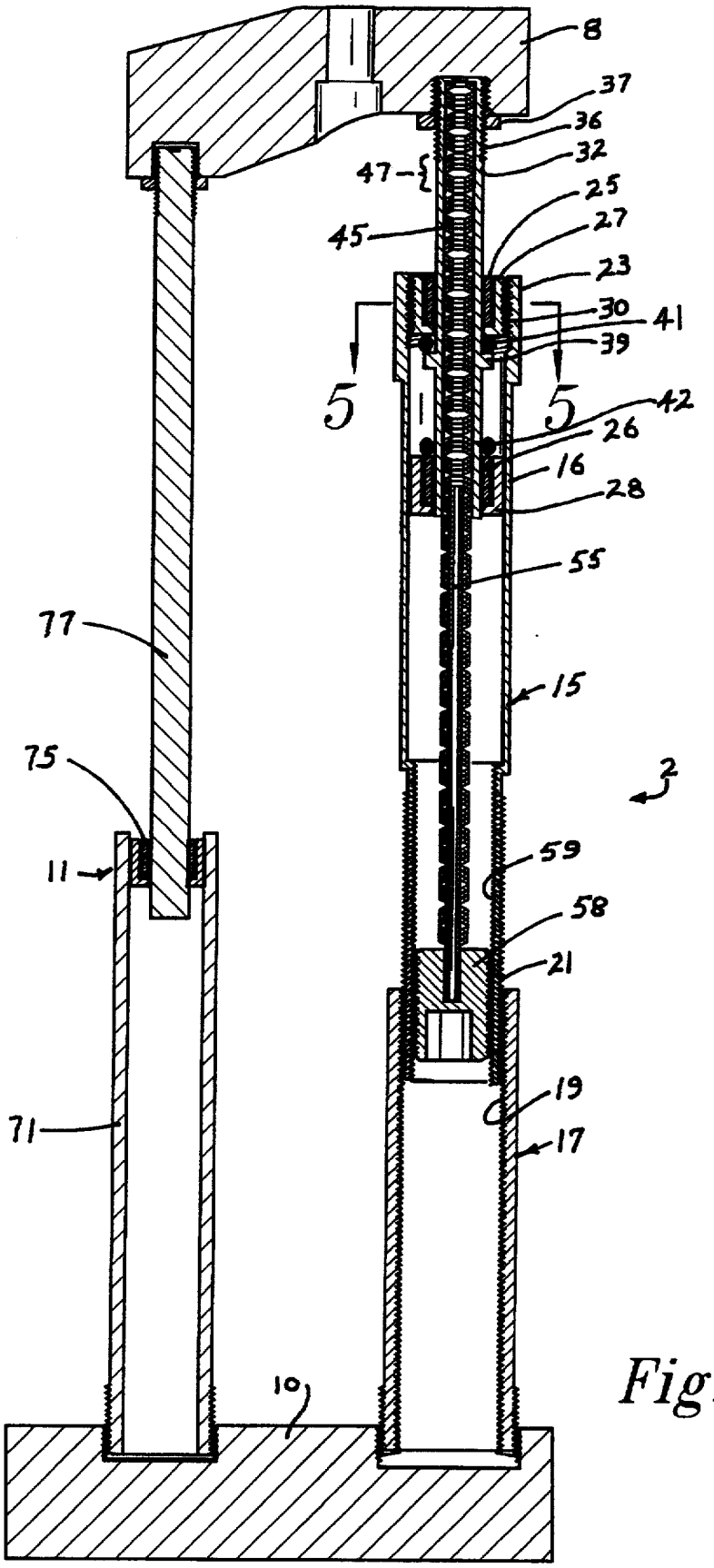
FIG. 3 is a longitudinal cross section of the firearm stock of the present invention.
Figure 5:
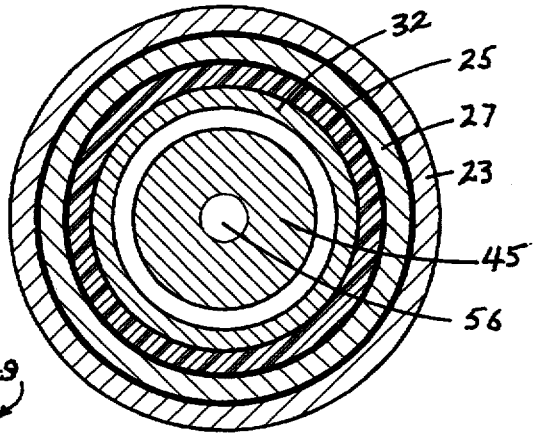

FIG. 5 is a cross sectional view taken along lines 5—5 of FIG. 3.

Figure 6:
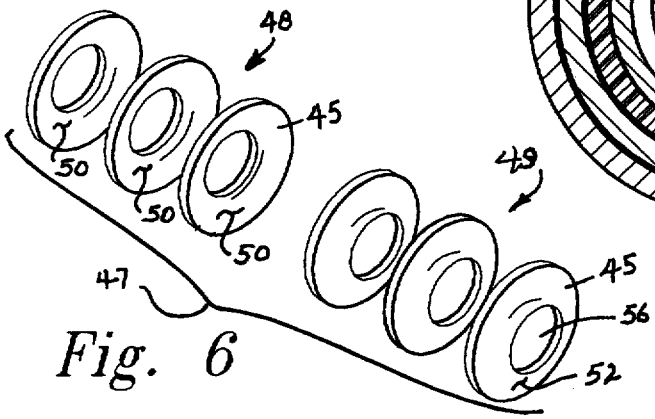

FIG. 6 is a perspective and exploded view of the arrangement of disc springs employed in the present invention, where the three exemplary springs on the left within the bracket are nested back to back and the three exemplary springs on the right within the bracket are nested back to back and are facing the three springs on the left. Labeled as "prior art", FIG. 6 also shows the typical arrangement of disc or Belleville springs which relies solely on the spring action of the devices to counteract compression force, as opposed to the arrangement of springs of the present invention, which derives additional resistance to compressive force and additional energy absorption from the friction of the nested springs, one on the other as they move to a flattened position.

Figure 7:
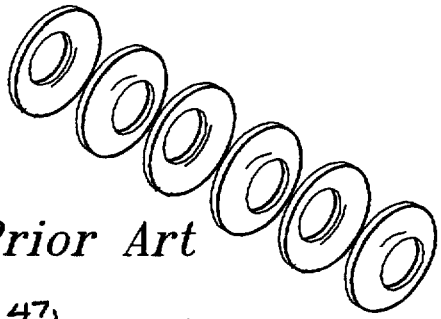
Figure 7:
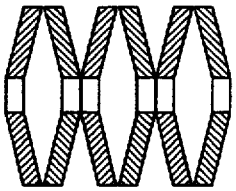
Figure 7:
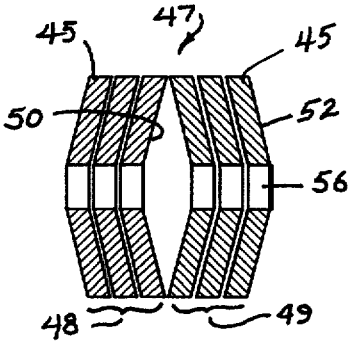

FIG. 7 is a cross sectional view of the springs described in FIG. 6, although they are shown close together and not in an "exploded" form. The springs are shown as they would typically appear in a normal or at rest position, as illustrated in FIG. 4*a*.

Figure 8:
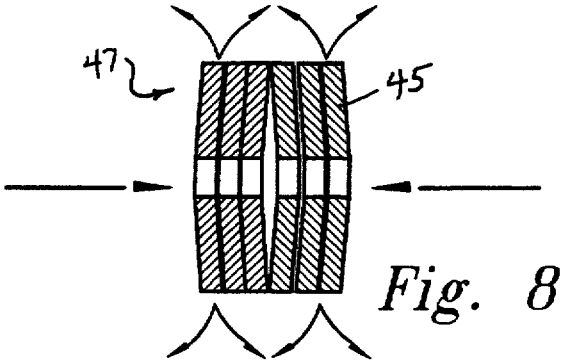

FIG. 8 is similar to FIG. 7 except that the springs are shown in a compressed position as they would appear during the period following discharge of the firearm, as shown in FIG. 4*b*.

Figure 2:
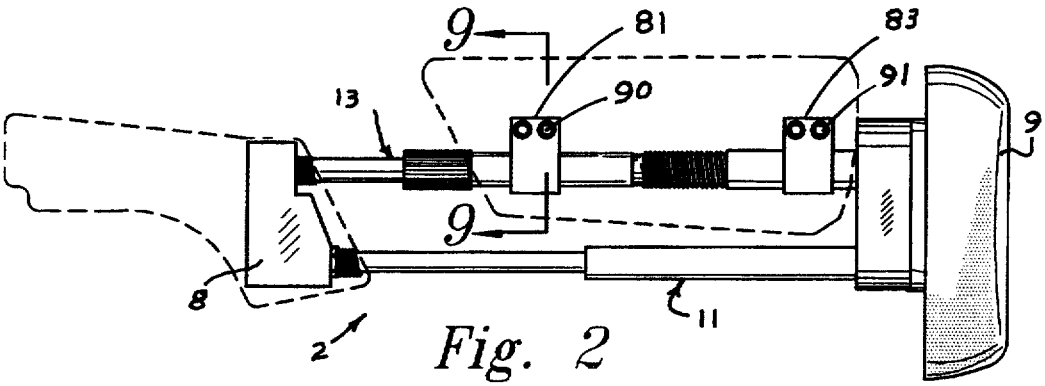
FIG. 2 is a side elevation view of the firearm stock of the present invention with the grip and the cheek piece shown in phantom to reveal the structure within and behind those elements.
Figure 9:
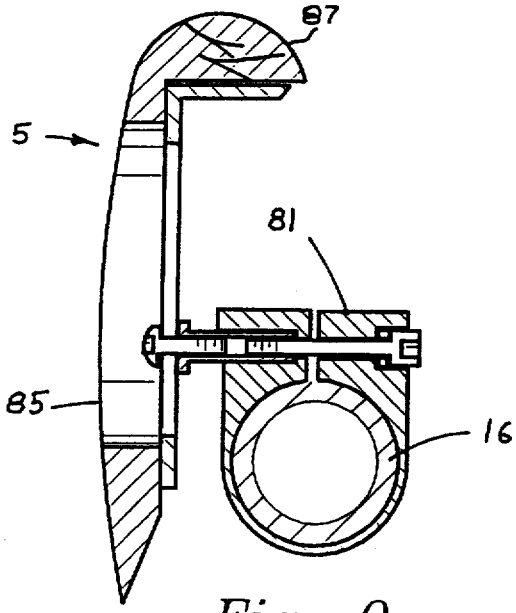

FIG. 9 is a cross sectional view taken along lines 9—9 of FIG. 2 showing only the mounting details of the cheek piece and omitting any showing of the apparatus inside of the tubular element.

Figure 10:
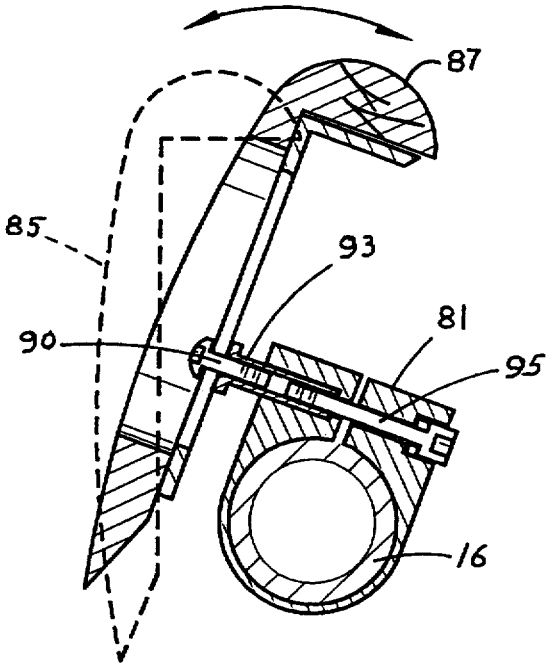

FIG. 10 is similar to FIG. 9 but showing rotational adjustment of the cheek piece.

Figure 11:
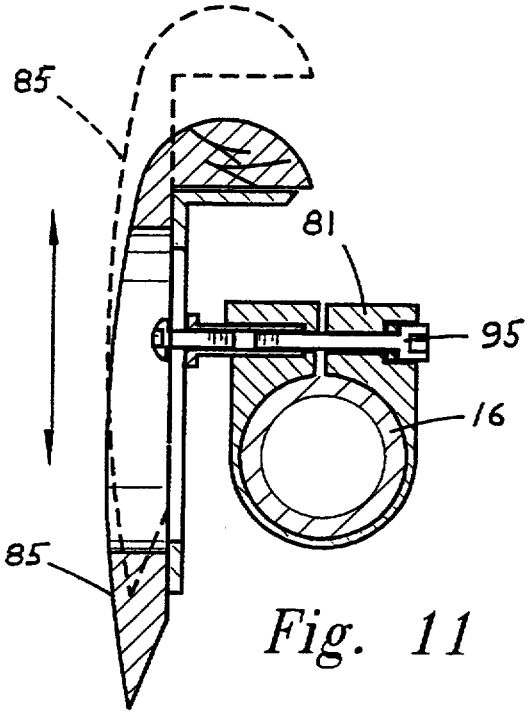

FIG. 11 is similar to FIG. 9 but showing vertical adjustment of the cheek piece.

Figure 12:
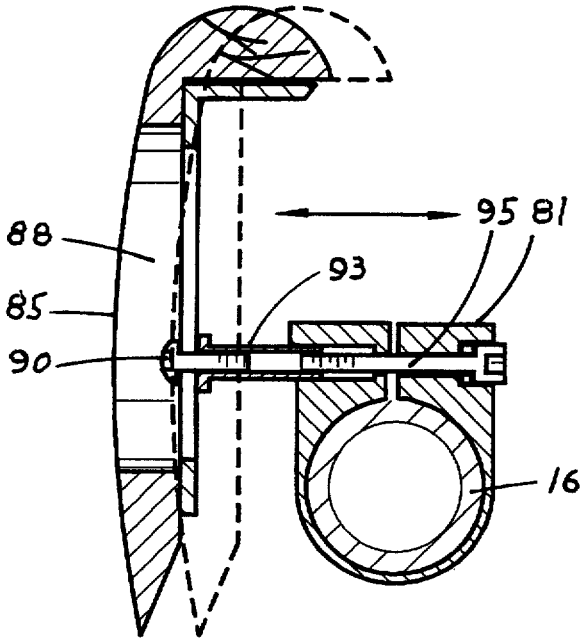

FIG. 12 is similar to FIG. 9 and showing the lateral adjustment of the cheek piece.

Figure 13:
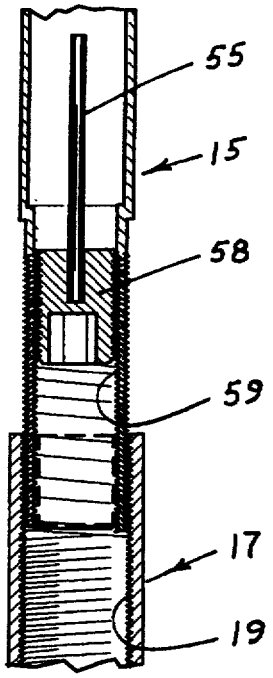

FIG. 13 is a fragmentary longitudinal cross sectional view taken through that portion of the absorber strut which houses the spring tensioning screw, showing the change in position of the tensioning screw and guide rod from that shown in FIG. 3. The disc springs which surround the guide rod have been omitted for clarity.

Figure 14:
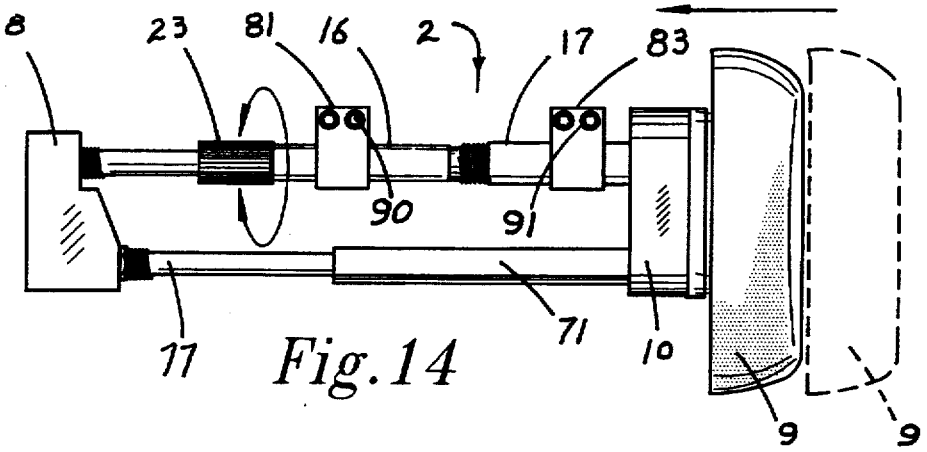

FIG. 14 is a side elevational view demonstrating the functioning of the stock length adjustment feature with the extended stock length shown by the butt in phantom lines and the shortened stock length shown in full lines.

SUMMARY OF THE INVENTION

The recoil absorbing gun stock of the present invention includes a pair of parallel compression struts mounted between the grip and the butt end of a gun stock. One of the struts includes an adjustable length cylinder having a telescoping shaft where the shaft is attached at its free end to the stock grip and where the free end of the cylinder is attached to the stock butt. Within the adjustable length cylinder is a longitudinally moveable plug which carries a rod coaxial with the cylinder. The free end of the rod is disposed within the hollow interior of the telescoping shaft for longitudinal movement therein as the plug is moved within the cylinder. Between the stock grip and the plug are a plurality of stacked disc shaped springs which are coaxially arranged within the tubular shaft and circumscribed around the rod so that as the rod moves longitudinally of the cylinder the rod will either penetrate or withdraw from the central apertures in the disc springs. When the gun is fired the recoil energy tends to compress the stock against the shoulder of the shooter, thus telescoping the shaft further into the cylinder and flattening the disc shaped springs which absorb the energy through their histolic spring action and through the friction between the adjacent springs in the stack.

DETAILED DESCRIPTION OF THE INVENTION

Figure 1:
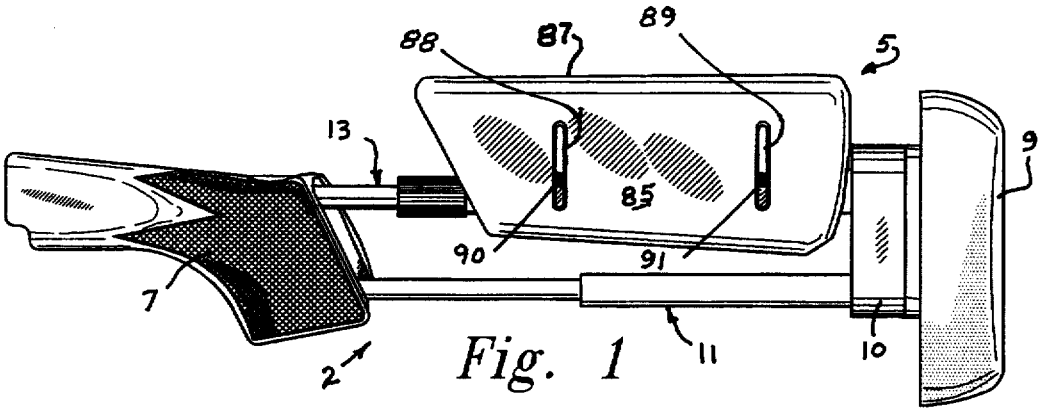
FIG. 1 is a side elevational view of the firearm stock of the present invention.

FIGS. 1 and 2 of the drawings illustrate the firearm stock elements and those of the recoil mechanism, which together comprise the gun stock 2 and cheek piece 5. The forward grip 7 of the stock attaches directly to the gun receiver (not shown) and supports the forward ends of the two primary stock forming pieces, a telescoping stabilizing strut 11 and the recoil absorber strut 13. An elastic shoulder contacting stock butt 9 carries the rearward ends of the struts 11 and 13. A cheek piece 5 is mounted on the absorber strut 13.

Examining first the absorber strut 13, attention is directed to FIG. 3. Cylindrical fore and aft housings 15 and 17 are interconnected by the mating of the internal threads 19 of the aft housing 17 and the external threads 21 of the fore housing 15. Interaction between these threaded elements results in the shortening or lengthening of the cylindrical strut structure formed by the interconnected housings 15 and 17 and constitutes the means for modifying the length of the stock 2. The fore housing 15 is a unitary cylinder having at the most forward end of its body portion 16 an enlarged diameter knurled integral nut 23 for providing a finger grip for rotating the fore housing about its longitudinal axis within the threads 19 of the aft housing 17 to implement length adjustment. The lower half of the fore housing 15 is a reduced diameter portion carrying the exterior threads 21 which engage the interior threads 19 of the aft housing 17.

The body portion 16 houses a front bushing 25 which is supported in position by a cup shaped bushing retainer 27 which is threaded over its outside circumference so as to engage the interior threads 30 on the inside of the fore housing nut 23 to secure it in place. A rearward bushing 26 and its retaining cup 28 are press fitted into the bore of the fore housing cylinder 15.

Slidably disposed within the bushings 25 and 26 is a cylindrical recoil tube 32 whose forward end is attached by threads 36 and a locking nut 37 to a metal backing plate 8 anchored in the back face of the grip 7 of the stock 2. Intermediate the ends of the recoil tube 32 is an enlarged diameter annular flange 39 positioned to co-act with the bushing retainers 27 and 28 to provide bi-directional stops against the slidable movement of the tube. Rubber "O" rings 41 and 42 are disposed circumferentially around the tube 32 on both longitudinal sides of the annular flange 39 to cushion the engagement of the flange with the retainers 27 and 28 when the full "stop" position of the tube is reached in either direction.

Coaxially disposed within the recoil tube 32 are a plurality of dished-disc or bent plate springs 45. One of the novel aspects of this invention is the manner in which these springs are organized with respect to one another. As best seen in FIGS. 6 and 7, the springs are arranged in sets 47 with adjoining sets being positioned "back to back". A single set of springs 47 comprises two opposing groups of springs 48 and 49, each group comprising a plurality of nested or stacked springs so that their individual concave sides 50 all face in the same direction. The concave sides 50 of one group are positioned to face or oppose the concave sides of another group, the two facing groups forming a set 47. The convex sides 52 of each group in each set of springs are placed back to back with the corresponding convex sides 52 of an adjoining set.

In addition to the spring sets which occupy the length of the recoil tube 32, sets of similar springs are coaxially mounted on a spring guide rod 55, the front end of which is introduced into the rearward opening of the recoil tube 32, as shown in FIGS. 3, 4*a* and 4*b*. The other end of the guide rod 55 is secured in the diametrical center of a spring tension screw 58 whose outside circumferential threads engage the threads 59 on the inside surface of the reduced diameter end portion of the fore housing 15. Turning of the screw 58 moves the spring tension screw and the imbedded guide rod 55 axially into or out of the center apertures 56 of the spring sets 47 which are positioned inside the recoil tube 32. The tension screw 58, which abuts the last one of the springs in the stack comprised of those spring sets within the tube 32 and those circumferentially mounted on the guide rod 55, applies compressive pressure to the stack of springs, depending on the adjusted longitudinal position of the tension screw. This adjustment and its resultant biasing force on the stack of springs determines the recoil characteristics of the mechanism. If the compressure force of the tension screw 58 is light and the springs are more relaxed or closer to their free normal configuration, the full recoil potential of the device is available. Tighter adjustment of the tension screw with more initial compression of the spring stack results in the accommodation of heavier loads.

Disposed parallel to the recoil strut 13 is a stabilizing strut 11, also interconnecting the grip backing plate 8 and the stock butt backing plate 10. The stabilizing strut comprises a rearwardly positioned cylindrical tube 71 which is attached at one of its ends to the butt backing plate 10. The other end of the tube 71 houses an interiorly disposed bushing 75. In sliding engagement with the bushing 75 is a telescoping stabilizing tube 77, the forward end of which is anchored to the frontal backing plate 8. The primary function of the stabilizing strut is to provide structural and rotational stability between the grip 7 and the stock butt 9, while at the same time allowing for recoil compression of the stabilizing member simultaneously with the compression of the recoil strut 13 when the gun is fired.

In operation, when the gun is fired and the projectile is driven down the barrel the equal and opposite reaction energy, according to Newton's law, will be absorbed by the compression of the longitudinally movable members of the recoil strut, acting against the spring tension and inter-disc friction of the springs 45. The novel arrangement of the disc springs, as described above, provides a mechanism for absorbing the recoil energy by two different means. The first means for reducing the perceived recoil is the tendency of the recoil tube, during its compression stroke when the gun is fired, to flatten the otherwise cone shaped springs, as shown in FIG. 4*b* of the drawings. The spring reaction to compression lengthens the recoil pulse while at the same time reducing its peak amplitude. The second mechanism for absorbing recoil energy is the friction between the back to front surfaces of the nested individual springs in a group which is expended as heat energy when the springs are driven into a flattened state. A typical recoil tube will contain a total of over 400 disc springs 45 and the friction created between adjacent nested springs is substantial, removing significant energy from the system, in addition to the energy absorbed by the actual flattening of the springs during compression. From the shooter's viewpoint, the stock of the gun shortens momentarily after firing, but the butt of the gun stays firmly planted against the shoulder without the normal recoil impact caused by the energy liberated rearwardly by the explosion in the firing chamber.

The cylindrical fore and aft housings 15 and 17 provide an exceptionally advantageous mounting base for the cheek piece 5. A pair of clevises 81 and 83 are clamped onto the larger diameter smooth surfaced portion 16 of the fore housing 15 and to the cylindrical aft housing 17, respectively, and are adjustably secured thereon for selectively positioning the cheek piece to fit the shooter's needs. The cheek piece 5 comprises a contoured surface having a relatively flat inner face 85 with a turned and smoothed upper edge 87. Two parallel slots 88 and 89 are provided in the flat face for receiving the heads of retaining screws 90 and 91. The heads of the retaining screws abut against edge flanges of the slots which are recessed beneath the surface of the inner face 85 of the cheek piece 5. The adjusting screws 90 and 91 are threaded into flanged sleeves, such as the one 93, shown in FIGS. 9–12 which sleeves are maintained in the respective clevises with a clevis fastening bolt 95.

The adjustment shown in FIG. 10 may be achieved by loosening the clevis bolt 95 and rotating the clevis around the axis of the mounting tube 16, as shown by the double headed arrow.

A vertical adjustment may be taken by loosening the retaining screws 90 and 91 to raise or lower the cheek piece with the screws moving relative to the slots 88 and 89 respectively, as illustrated in FIG. 11.

FIG. 12 is illustrative of the lateral adjustment which is made possible though the relative positioning of the clevis bolts 95 and the sleeves 93 into which they are threaded.

I claim:

1. A gun stock for absorbing recoil energy in a shoulder firearm having a receiver and firing chamber, comprising, a stock butt portion, a stock grip portion attached to the receiver of the firearm, at least one compressible first strut interconnecting the butt portion and the grip portion and carrying compressible spring means to absorb the recoil energy, said first strut comprising cylinder means having one end thereof secured to the stock butt portion, a tubular shaft telescopically disposed within the cylinder means and where one end thereof emerges from the cylinder means and is attached to the stock grip portion, plug means disposed within the cylinder means intermediate its ends, a rod having first and second ends disposed within the cylinder means where said first end is secured to the plug means and the second end is disposed within the said tubular shaft a stack of compressible disc shaped springs disposed within said tubular shaft and circumscribed around the rod between the stock grip portion and the plug means.

2. The combination of claim 1 wherein the plug means is movable longitudinally of the cylinder means to selectively bias the disc springs.

3. The combination of claim 2 where the cylinder means includes fore and aft coaxial housing cylinders which include means for adjustably interconnecting the said cylinders to vary their total length and thereby vary the distance between the stock grip portion and the stock butt portion.

4. The combination of claim 3 and further including fore and aft bushings to journal the shaft within the fore housing cylinder.

5. The combination of claim 4 where the tubular shaft includes an annular flange disposed between the fore and aft bushings to control the extent of relative movement between the tubular shaft and the fore housing cylinder.

6. The combination of claim 5 and further including, a second compressible strut interconnecting the butt portion and the stock grip portion.

7. The combination of claim 1 and further including a rigid cheek support member carried by the said cylinder means.

8. The combination of claim 7 where the cheek support member includes, a contoured face plate, a plurality of clevis clamps each having opposing legs and attached to the cylinder means, and a plurality of coaxial threaded adjustment screws interconnecting the legs of the said clevises and the face plate.

* * * * *